US012697537B2

(12) United States Patent
Swain

(10) Patent No.: US 12,697,537 B2
(45) Date of Patent: Aug. 4, 2026

(54) NET SECURING DEVICE

(71) Applicant: Cynthia Lewis Swain, Caledonia, MI (US)

(72) Inventor: Cynthia Lewis Swain, Caledonia, MI (US)

( * ) Notice: Subject to any disclaimer, the term of this patent is extended or adjusted under 35 U.S.C. 154(b) by 283 days.

(21) Appl. No.: 18/658,208

(22) Filed: May 8, 2024

(65) Prior Publication Data

US 2024/0390763 A1 Nov. 28, 2024

Related U.S. Application Data

(60) Provisional application No. 63/503,638, filed on May 22, 2023.

(51) Int. Cl.

| | |
|---|---|
| ***A63B 71/02*** | (2006.01) |
| ***A63B 102/02*** | (2015.01) |
| ***A63B 102/04*** | (2015.01) |
| ***A63B 102/08*** | (2015.01) |

(52) U.S. Cl.

CPC ..... *A63B 71/023* (2013.01); *A63B 2102/02* (2015.10); *A63B 2102/04* (2015.10); *A63B 2102/08* (2015.10); *A63B 2210/50* (2013.01); *A63B 2225/055* (2013.01); *A63B 2243/0095* (2013.01)

(58) Field of Classification Search

CPC ..... A63B 71/023

See application file for complete search history.

(56) References Cited

U.S. PATENT DOCUMENTS

| | | | | |
|---|---|---|---|---|
| 7,229,059 | B1 * | 6/2007 | Hood | F16M 13/022 248/205.8 |
| 11,691,060 | B1 * | 7/2023 | Burns, III | A63B 61/003 473/415 |
| 2007/0117659 | A1 * | 5/2007 | Best | A63B 71/023 473/474 |

* cited by examiner

*Primary Examiner* — Yingchuan Zhang

(74) *Attorney, Agent, or Firm* — Oppenhuizen Law PLC; David L. Oppenhuizen

(57) ABSTRACT

A pole system for supporting a sports net, the pole system including a net post, a receiver pole, a support base, and a plurality of suction cups. The net post, designed for temporary attachment to the net, is partially received within the central area of the receiver pole. The support base, attached to the receiver pole, comprises outwardly extending base members, each ending with a suction cup for temporary ground attachment. The pole system, constructed from materials such as metal, plastic, fiberglass, or wood, can adapt to varying base member configurations. A threaded screw mechanism further ensures secure retention of the net post within the receiver pole. The invention offers a novel, efficient, and cost-effective solution for setting up sports nets, ensuring stability and ease of assembly.

13 Claims, 3 Drawing Sheets

NET SECURING DEVICE

CROSS REFERENCE TO RELATED APPLICATION

This application claims the benefit of U.S. Provisional Application 63/503,638, which was filed on May 22, 2023, the disclosure of which is hereby incorporated by reference.

BACKGROUND OF THE INVENTION

1. Field of the Invention

The present invention pertains to a device for temporarily securing a net post in place to hold a net. More particularly, the present invention pertains to a device for temporarily securing a net post in place using a plurality of suction cups.

2. Description of the Prior Art

Sports such as volleyball, tennis, pickleball, and badminton require a net to be held tautly between two poles. The conventional poles used for holding the sports net are usually either permanently installed in the ground or are portable, but lack stability and secure positioning.

The conventional pole systems often suffer from several drawbacks. One of the major issues with these systems is that their setup and dismantling can be cumbersome and time-consuming. Additionally, these pole systems often lack the necessary stability, especially on uneven or slippery surfaces. This instability can cause the net to sag or the poles to fall, disrupting the game and potentially causing injury to the players.

Another significant problem with existing pole systems is their lack of versatility. Many of these systems are designed for a specific type of surface, such as grass or sand, and are not suitable or stable on other types of surfaces. This limits their usefulness, as they cannot be used in different locations or for different sports.

Some solutions have been attempted to address these issues. For instance, pole systems with weighted bases have been used to improve stability. However, these can be quite heavy and difficult to transport. Alternatively, some pole systems use stakes or anchors that are driven into the ground. While this can provide stability, it is not suitable for hard or paved surfaces and can cause damage to the ground.

Therefore, there is a need to overcome the problems discussed above. A pole system for supporting a net is needed that is easy to set up and dismantle, stable on a variety of surfaces, and versatile enough for use with different sports. This pole system should also be lightweight for easy transport, yet secure enough to hold the sports net tautly during play.

SUMMARY OF THE INVENTION

The invention pertains to a pole system designed for supporting a sports net. The system comprises a net post, a receiver pole, a support base, and a plurality of suction cups. The net post, configured for temporary securement to an end of the sports net, is received within an open central area of the receiver pole.

The support base, fixedly secured to the receiver pole, has a plurality of base members extending outwardly from a central position. The suction cups, secured to the distal end of each base member, are oriented to extend downwardly and in an opposite direction of extension from that of the receiver pole.

The pole system includes a plurality of base members. Preferably four base members are included, and in that instance each base member is positioned perpendicular from the adjacent base members. Three of these base members may be substantially equal in length, while the fourth base member is longer than the other three. The fourth base member can either extend toward or away from the sports net, depending on the specific configuration.

In another embodiment, the pole system may include only three base members. Furthermore, the net post and the receiver pole may be cylindrical in shape, and the net post may have a specific thickness and height. Industrial-grade plastic suction cups, such as those sold under the trademark Seasucker®, may be used.

The pole system may include a threaded screw that can be grasped by a user's hand. The receiver pole includes a threaded hole complementary to the threaded screw, allowing the screw to be threaded into the hole and abut the net post to securely retain the net post within the receiver pole.

In another embodiment, the pole system can include a plurality of support members, each extending between the receiver pole and a respective one of the base members. This configuration further enhances the stability of the pole system.

The present invention also encompasses a net system for playing racket sports, comprising two of the aforementioned pole systems and a sports net. The sports net is configured to be secured to each of the net posts, thereby being suspended tautly between the pole systems.

For a more complete understanding of the present invention, reference is made to the following detailed description and accompanying drawings. In the drawings, like reference characters refer to like parts throughout the views in which:

DETAILED DESCRIPTION

Figure 1:
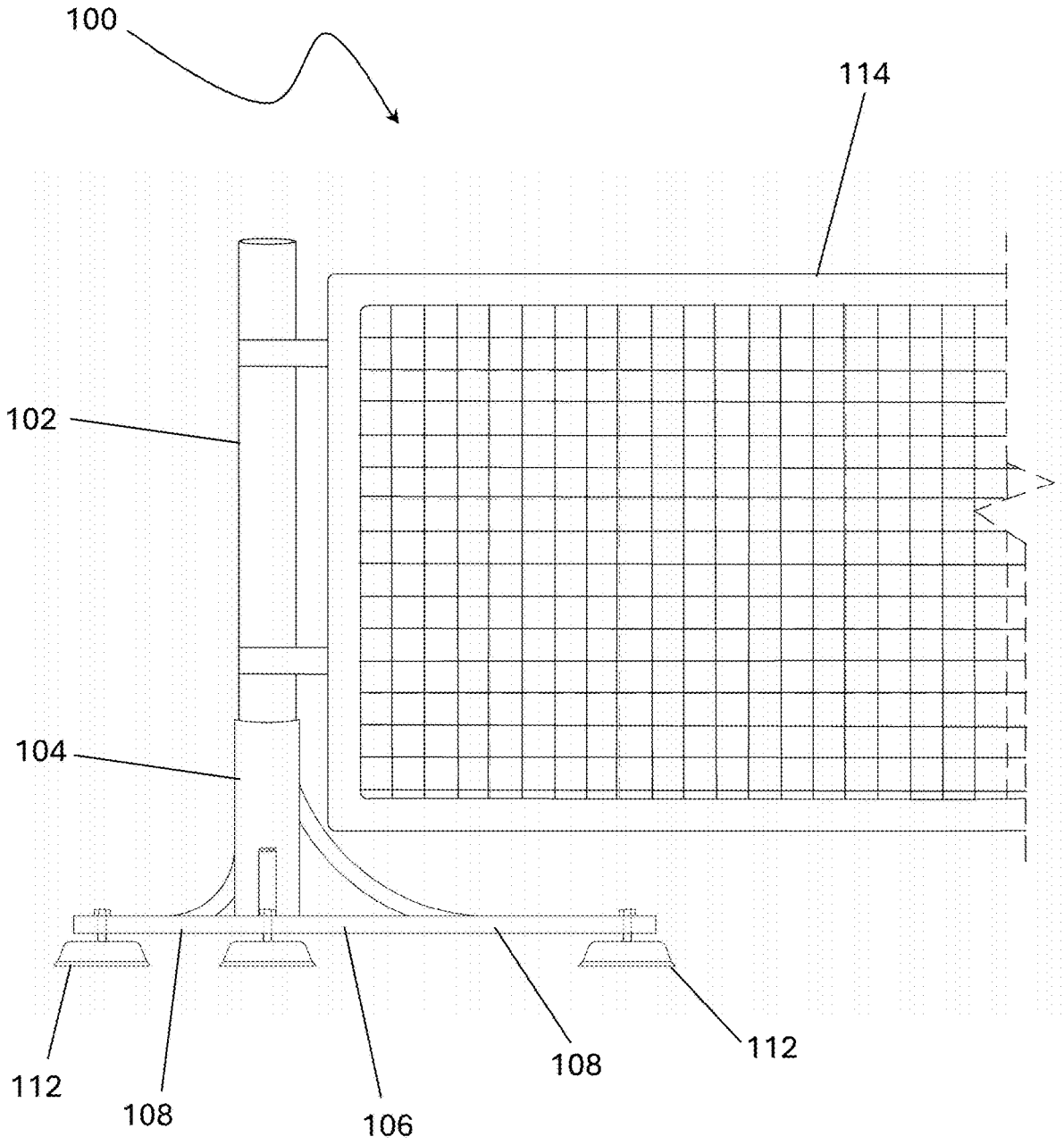
FIG. 1 is a front partial view of a first embodiment of the pole system hereof.
Figure 2:
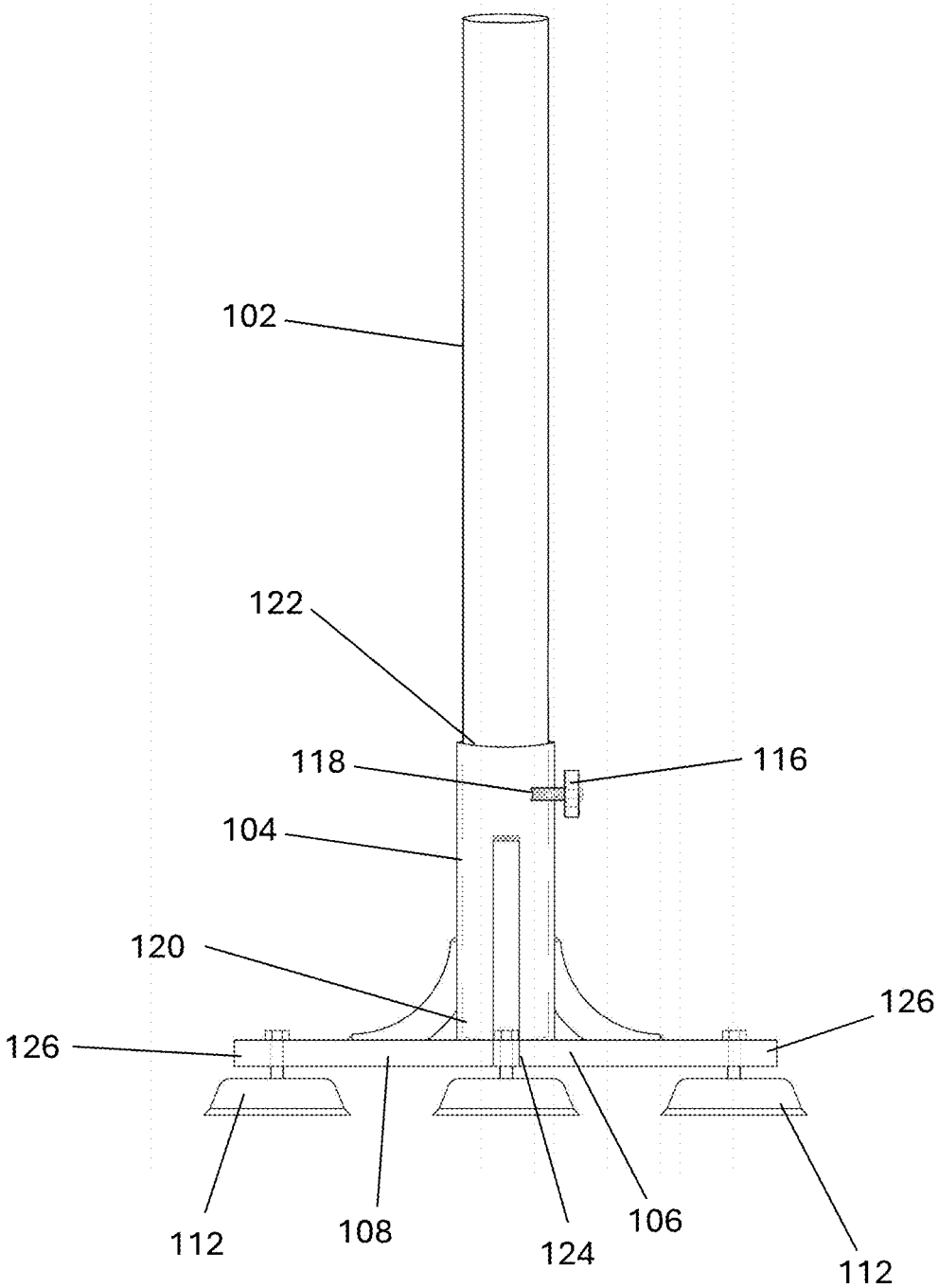
FIG. 2 is a side view thereof.
Figure 3:
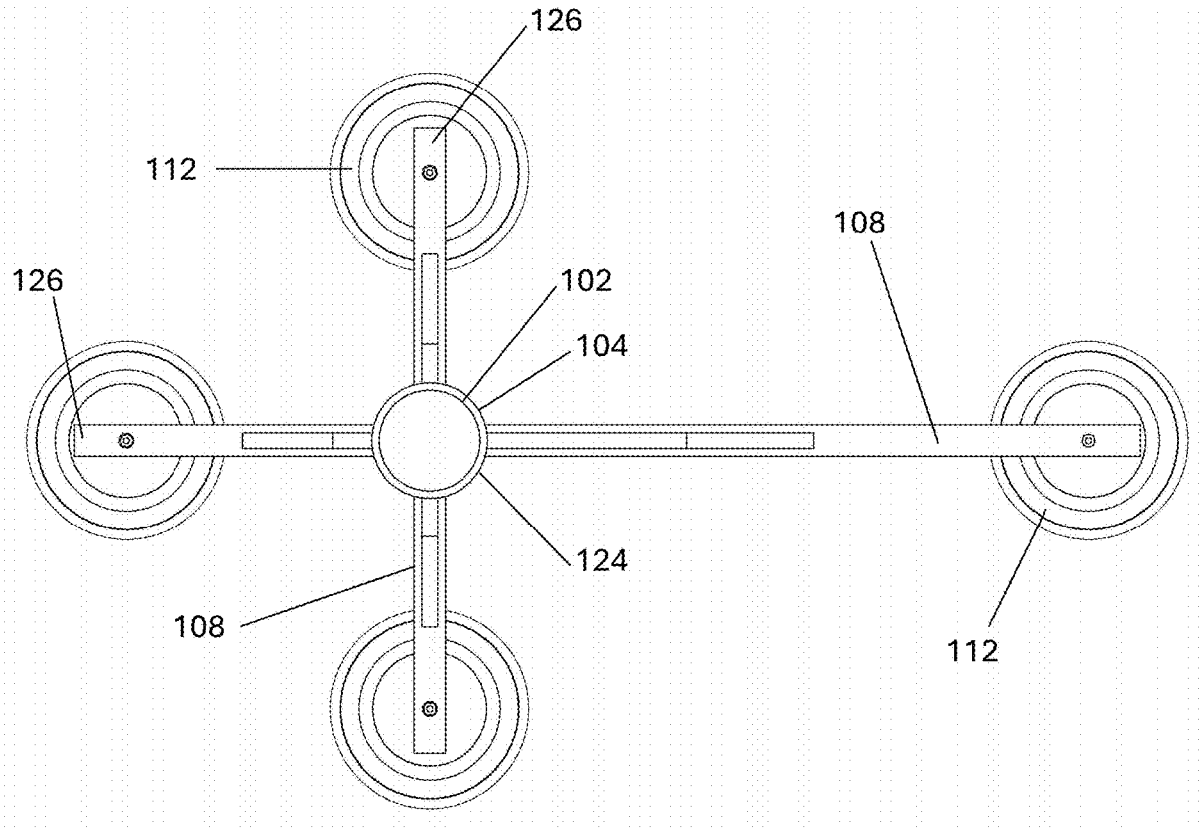
FIG. 3 is a top view thereof.

The present invention pertains to a pole system used for holding a sports net. The pole system comprises a net post, a receiver pole, a support base, and a plurality of suction cups. The net post, having an elongated length, is designed for temporary securement to an end of the sports net. The receiver pole is designed to receive a portion of the net post within its open central area, allowing the net post to extend upwardly and partially out of the upper end.

The support base of the pole system comprises a plurality of base members. These base members extend outwardly from a central position and terminate at a distal end. The support base and the receiver pole are fixedly secured to one another, with the lower end of the receiver pole secured to the central position of the support base. This configuration allows the receiver pole to extend upwardly from the support base.

The pole system also includes a plurality of suction cups. Each of the suction cups is secured to the distal end of each of the respective base members. These suction cups are oriented to extend downwardly and in an opposite direction of extension from that of the receiver pole. This design allows the suction cups to temporarily secure the pole system to a ground surface.

The net post, the receiver pole, and the support base of the pole system can be formed from various materials. These materials include, but are not limited to, metal, plastic, fiberglass, and wood. The choice of material can be based on factors such as durability, cost, and the specific requirements of the sports net.

The support base of the pole system may comprise four base members. Each of these four base members is positioned perpendicular from the adjacent base members. This arrangement provides stability and balance to the pole system.

In some embodiments, three of the base members are substantially equal in length, and a fourth of the base members is longer than the other three base members. The fourth longest base member may extend toward the sports net, providing additional support and stability.

Alternatively, the fourth longest base member may extend away from the sports net. This configuration can provide additional balance, preventing the pole system from tipping over.

In other embodiments, the support base may comprise three base members. This configuration can provide a compact and lightweight design, making the pole system easy to transport and set up.

The net post and the receiver pole of the pole system may be cylindrical in shape. This design can provide a secure fit, ensuring that the net post stays in place during use.

The net post of the pole system may have a thickness of substantially 5.08 centimeters. This thickness provides a sturdy and robust structure, capable of withstanding the stresses of a sports game.

The net post may also have a height of substantially 91.4 centimeters. This height is suitable for a variety of sports, including tennis and pickleball. However, taller versions of the net post can be provided for other sports like volleyball and badminton.

The suction cups used in the pole system may be industrial-grade plastic suction cups of the type sold under the trademark Seasucker®. These suction cups provide a strong and reliable grip, ensuring that the pole system stays in place during use.

The pole system may also include a threaded screw. The head of the screw is designed to be grasped by a user's hand. The receiver pole includes a threaded hole which is complementary to the threaded screw, allowing the screw to be threaded into the hole and abut the net post. This design securely retains the net post within the receiver pole.

Each of the base members of the support base may be positioned in an array and radiate outwardly from the central position. This arrangement provides stability and balance to the pole system.

The receiver pole may be oriented perpendicular to the plurality of base members. This orientation provides a secure and stable structure for holding the sports net.

The pole system may also include a plurality of support members. Each support member extends between the receiver pole and a respective one of the base members, providing additional support and stability to the pole system.

The invention also relates to a net system for playing racket sports. The net system comprises two of the pole systems as described above, and a sports net. The sports net is designed to be secured to each of the net posts, allowing the sports net to be suspended tautly between the pole systems.

In accordance with an embodiment and as shown generally in FIG. 1, the pole system 100 comprises a net post 102, receiver pole 104, support base 106, and multiple suction cups 112. The net post 102, with an elongated length, is designed for temporary attachment to an end of the sports net 114, allowing flexibility in setup and disassembly. This is beneficial in situations where the sports net 114 might need to be frequently moved or used temporarily. The net 114 is secured to the net post 102 using any suitable mechanism that is known in the prior art, such as straps having hook-and-loop connections, elastic cords, rope ties, and so forth.

The receiver pole 104, another part of the pole system 100, is designed with a lower end 120, an open upper end 122, and an open central area. It is made to receive a portion of the net post 102 within this open central area. This structure of the receiver pole 104 allows it to hold the net post 102 securely and stably. Optionally, the net post 102 and the receiver pole 104 may be dimensioned so that the net post 102 slides tightly into the receiver pole 104 to ensure that the net post 102 is held tightly in place. The net post 102 and the receiver pole 104 can have any other suitable cross-sectional shape, such as rectangular, triangular, oval, and so forth.

The support base 106, which is part of the pole system 100 as well, comprises a plurality of base members 108. The base members 108 extend outwardly from a central position 124 and end at a distal end 126 thereof. The support base 106 and the receiver pole 104 are fixedly attached to each other, providing a sturdy and stable structure for holding the sports net 114.

The pole system 100 also includes a plurality of suction cups 112, each secured to the distal end 126 of a respective base member 108. These suction cups 112, oriented to extend downwardly and in the opposite direction from that of the receiver pole 104, are designed to temporarily secure the pole system 100 to a ground surface. The plurality of suction cups 112 are industrial-grade plastic suction cups which are preferably, but not necessarily, of the type sold under the trademark Seasucker®.

Another embodiment of the pole system 100 includes the net post 102, receiver pole 104, and support base 106 made from a range of materials such as metal, plastic, fiberglass, or wood. This allows for a level of customization depending on user preference and the specific requirements of a sporting event.

In a further embodiment, the pole system 100 comprises four base members 108. Each of the base members 108 is positioned perpendicularly to the adjacent base member 108. This arrangement ensures the system 100 remains stable, even when subjected to forces from various directions.

In some configurations, three of the base members 108 are approximately equal in length, while a fourth is longer. The longest base member 108 can extend towards or away from the sports net 114, depending on the specific configuration of the pole system 100, providing additional support or stability.

In another embodiment, the pole system 100 includes only three base members 108. This configuration offers a more compact and lightweight design, making the system 100 more convenient for transportation and setup.

The pole system 100 may also include a threaded screw 116 mechanism. The screw 116, designed to be gripped by a user's hand, is threaded into a complementary threaded hole 118 in the receiver pole 104, securing the net post 102 within the receiver pole 104. This feature provides an added level of stability to the pole system 100, and also helps retain the net post 102 within the receiver pole 104.

In another embodiment, the pole system 100 uses industrial-grade plastic suction cups 112, providing excellent grip strength on various surfaces. This enhances the usability and performance of the pole system 100, making it suitable for a variety of ground conditions.

The pole system 100 provides a novel, efficient, cost-effective solution for setting up sports nets 114. It offers considerable advantages over traditional systems, including ease of assembly and disassembly, stability across a range of ground conditions, and adaptability for different sports.

In addition to racket sports, the pole system 100 could find use in other sports where a net 114 needs to be set up temporarily. It could also find application in non-sporting contexts where a temporary, stable, and adjustable pole structure is required.

The pole system 100 offers several advantages. For one, it is lightweight and portable, making it easy to transport and set up. It offers a high degree of stability, even on uneven terrain, due to its unique base structure and use of suction cups 112. Furthermore, its adjustable design allows it to accommodate nets 114 of different heights and sizes.

It should be understood that the foregoing description is only illustrative of the aspects of the disclosed embodiments. Various alternatives and modifications can be devised by those skilled in the art without departing from the aspects of the disclosed embodiments. Accordingly, the aspects of the disclosed embodiments are intended to embrace all such alternatives, modifications, and variances that fall within the scope of the appended claims. Further, the mere fact that different features are recited in mutually different dependent or independent claims does not indicate that a combination of these features cannot be advantageously used, such as a combination remaining within the scope of the aspects of the disclosed embodiments.

What is claimed is:

1. A pole system for holding a sports net, the pole system comprising:

a net post, the net post having an elongated length and being configured for temporary securement to an end of the sports net;

a receiver pole having a lower end, an open upper end, and defining an open central area, the receiver pole being configured to receive a portion of the net post within the open central area, the net post extending upwardly and partially out of the upper end from the open central area;

a support base having four base members, each of the four base members being positioned perpendicular from the adjacent base members, the base members extend outwardly from a central position and terminate at a distal end, the support base and the receiver pole are fixedly secured to one another such that the lower end of the receiver pole is secured to the central position of the support base, and the receiver pole extends upwardly from the support base, wherein three of the base members are substantially equal in length, and a fourth of the base members is longer than the other three base members; and a plurality of suction cups, each of the suction cups being secured to the distal end of each of the respective base members, the plurality of suction cups oriented to extend downwardly and in an opposite direction of extension from that of the receiver pole, whereby the plurality of suction cups are configured to temporarily secure the pole system to a ground surface.

2. The pole system of claim 1 wherein the fourth longest base member extends toward the sports net.

3. The pole system of claim 1 wherein the fourth longest base member extends away from the sports net.

4. The pole system of claim 1 wherein there are three base members in the plurality of base members.

5. The pole system of claim 1 wherein the net post and the receiver pole are cylindrical.

6. The pole system of claim 1 wherein the net post has a thickness of substantially 5.08 centimeters.

7. The pole system of claim 1 wherein the net post has a height of substantially 91.4 centimeters.

8. The pole system of claim 1 wherein the plurality of suction cups are industrial-grade plastic suction cups.

9. The pole system of claim 1 including a threaded screw having a head that is configured to be grasped by a hand of a user, and wherein the receiver pole includes a threaded hole which is complementary to the threaded screw such that the threaded screw is configured to be threaded into the threaded hole and abuts the net post to securely retain the net post within the receiver pole.

10. The pole system of claim 1 wherein each of the base members is positioned in an array and radiates outwardly from the central position.

11. The pole system of claim 1 wherein the receiver pole is oriented perpendicular to the plurality of base members.

12. The pole system of claim 1 including a plurality of support members, each support member extending between the receiver pole and a respective one of the base members.

13. A net system for playing racket sports, the net system comprising two of the pole systems of claim 1, and a sports net, the sports net being configured to be secured to each of the net posts, whereby the sports net is suspended tautly between the pole systems.

* * * * *